United States Patent [19]

Lonati

[11] 4,073,163

[45] Feb. 14, 1978

[54] CIRCULAR KNITTING MACHINE

[76] Inventor: Francesco Lonati, via Valsorda, 28, Brescia, Italy

[21] Appl. No.: 739,930

[22] Filed: Nov. 8, 1976

[51] Int. Cl. ..... D04b 9/10; D04b 15/08

[52] U.S. Cl. ..... 66/14; 66/111

[58] Field of Search ..... 66/14, 111

[56] References Cited

U.S. PATENT DOCUMENTS

| | | | |
|---|---|---|---|
| 2,737,793 | 3/1956 | Manger | 66/14 |
| 3,046,760 | 7/1962 | Peberdy | 66/14 |

*Primary Examiner*—Wm. Carter Reynolds

*Attorney, Agent, or Firm*—Guido Modiano; Albert Josif

[57] ABSTRACT

There is disclosed a circular knitting machine of the type including an upper and a lower needle cylinder and comprising a safety device for opening the latches of the double-hooked needles which are to be transferred from one needle cylinder to the other one. For this purpose the machine includes an auxiliary cam located upstream of the zone at which transfer of the needles occurs, the cam being arranged and shaped so as to bring all the sliders and corresponding needles movable along a floating track to a height in which the needle hook and corresponding latch contact the tip of the corresponding slider of the opposite needle cylinder, thus causing the latch to open by interaction between the needle and the tip of the slider. The machine also includes a subsequent cam for raising to a needle transfer position the sliders whose needles are to be transferred to the other needle cylinder and for newly lowering into the floating track the sliders whose needles are not to be transferred.

3 Claims, 3 Drawing Figures

PRIOR ART

CIRCULAR KNITTING MACHINE

BACKGROUND OF THE INVENTION

This invention relates to a circular knitting machine, and particularly to a double-cylinder knitting machine equipped with a safety device for opening the latches of the needles being transferred from one needle cylinder to the other.

As known in the art, on transferring a double-hooked needle in a double-cylinder circular knitting machine, e.g. when the needle is required to convert from plain stitch knitting over to purl stitch knitting, it is requisite of the needle to present its latch in the opened state, such that the appropriate hook of the slider intended to pick up the needle being transferred is enabled to insert itself into the space enclosed by the needle hook and engage said hook, preparatory to pulling the needle within the respective needle cylinder. At this stage, the slider also effects a swinging movement, projecting for a moment with its end out of the cylinder groove and then swings back to hook up the needle to be transferred.

If the latch is closed, it happens that, when the slider swings back to hook up the needle, it meets opposition to its hook by the closed latch, distorts the latter, and since the slider is urged to swing back by specially provided cams, breaks the latch and is itself damaged.

In order to prevent such occurrences, the cams located upstream of the transfer area are configurated such as to bring the slider and needle close to each other at the precise point where the closed latch approaches the needle hook, such that during the subsequent relative movement of the needle and slider the latter first inserts itself with its tip between the latch and the needle hook, and then gradually opens up the latch.

Such a system, however, requires that all the needles to be transferred be correctly brought to an accurate encounter with the slider, as explained above.

On the machines designed for a more complex operation, e.g. on circular knitting machines provided for "links-Jacquard" knitting, wherein two or three feeds are provided having different color threads and purl stitch operation is contemplated and various pattern drums are to be pre-arranged, it even more easily occurs, consequently to a mistake in the presetting of one of the pattern drums, that the needle to be transferred performs a wrong movement, thereby it reaches the transfer point with the latch in the non-opened state.

Assuming, for instance, the case of a "links-Jacquard" knitting machine, wherein the needles not involved in knitting at the feed located after the transfer area (considering the needle direction of movement with respect to the cams) must remain in a "floating" or low position, whereas both the needles which are to be operative at that feed and the needles which are to be transferred must follow a higher track. Now, if a needle to be transferred, rather than following the high track is erroneously brought by its slider to follow the "floating" track, then it will be raised anyhow to a transfer position by its pertinent underlying selecting jack, but will reach the height level for hooking up the slider of the other needle cylinder when this slider is swung out of its cylinder groove and thus is unable to open the needle latch, should the latter have stayed closed. In this case, the aforementioned events would occur, i.e. the breaking of the needle and slider as the latter swings back into the groove.

However, the correct arrangement of the pattern drums, that is the correct arrangement on such drums of the various so-called safety teeth or pins, which are operative to direct along the right track the sliders and needles associated therewith, is susceptible of errors that are greater the more complicated the knitting is. The absence of even a single tooth or pin arranged to bring the needle to be transferred to a position suitable for the opening of the latch is enough not only to result in a faulty product but also to break the slider and needle, thereby the machine must be stopped, the error on the drum located, the drum reassembled and the slider and needle replaced, thus causing considerable delay and loss of production.

SUMMARY OF THE INVENTION

It is a primary object of this invention to eliminate such a drawback by providing a machine with a safety device for the opening of the latches of the needles, which requires no pre-arrangement of special so-called safety teeth or pins, and which accordingly eliminates any chance of error connected with such tooth or pin arrangement.

It is another object of the invention to provide a device capable of preventing the breaking of the slider and needle even when the needle is incorrectly directed to the "floating" track.

It is a further object of this invention to provide a simple and low-cost device, easy to install even in a conventional design machine and the machines currently in use.

These and other objects, such as will be apparent hereinafter, are achieved by a circular knitting machine, particularly of the double-cylinder type, including a safety device for the opening of the needle latches, comprising transfer members facing each other within the two needle cylinders and needles engaging respectively one of said transfer members, and control cams for the butts of said transfer members defining at least a first track for the butts of the transfer members associated with the needles to be transferred and at least a second track for the butts of the transfer members associated with the needles not to be transferred, the machine being characterized in that it comprises an auxiliary cam located upstream of the transfer area and configurated to bring the needles associated with all the transfer members which are guided along said second track to a height level of contact with the respective facing transfer members of the other needle cylinder, thereby providing a gradual opening of the needle latches by said facing transfer members, and a subsequent cam configurated to bring the transfer members associated with the needles not selected for the transfer proper back to the level of said second track.

In such an embodiment, even though the transfer member or slider of a needle has failed to be correctly brought to the transfer track but stayed by mistake in the "floating" track, i.e. the track termed as the second track hereinabove, it would nevertheless be brought to encounter the slider such as to ensure the opening of the latch, thanks to the provision of the auxiliary cam and to the arrangement thereof, before the slider starts to swing toward the outside of its groove. Thus, any breakage during the slider swinging back stage is effectively prevented, even if the slider fails to start along the transfer track proper. Of all the sliders which move along the "floating" track, those associated with the needles to be transferred are then driven by their respective selecting jacks for the transfer proper of the needle, whereas the remaining ones, associated with the needles not to be transferred, are brought by the subsequent cam to the level of the "floating" track wherein they were previously located, since there are no selecting jacks to cause them to effect the transfer. With the inventive device, the opening of all the needles is thus advantageously provided, including the needles that are not to be transferred.

Most advantageously, the auxiliary cam may be arranged, either stationary or movable, at the "floating" track level or at a different level to act upon a slider butt different from the one engaged along the "floating" track.

BRIEF DESCRIPTION OF THE DRAWINGS

Further features and advantages of the invention will be more apparent from the ensueing description of a preferred, though not exclusive, embodiment thereof, provided by way of example and illustrated in the accompanying drawings, wherein.

DESCRIPTION OF THE PREFERRED EMBODIMENTS

Figure 1:
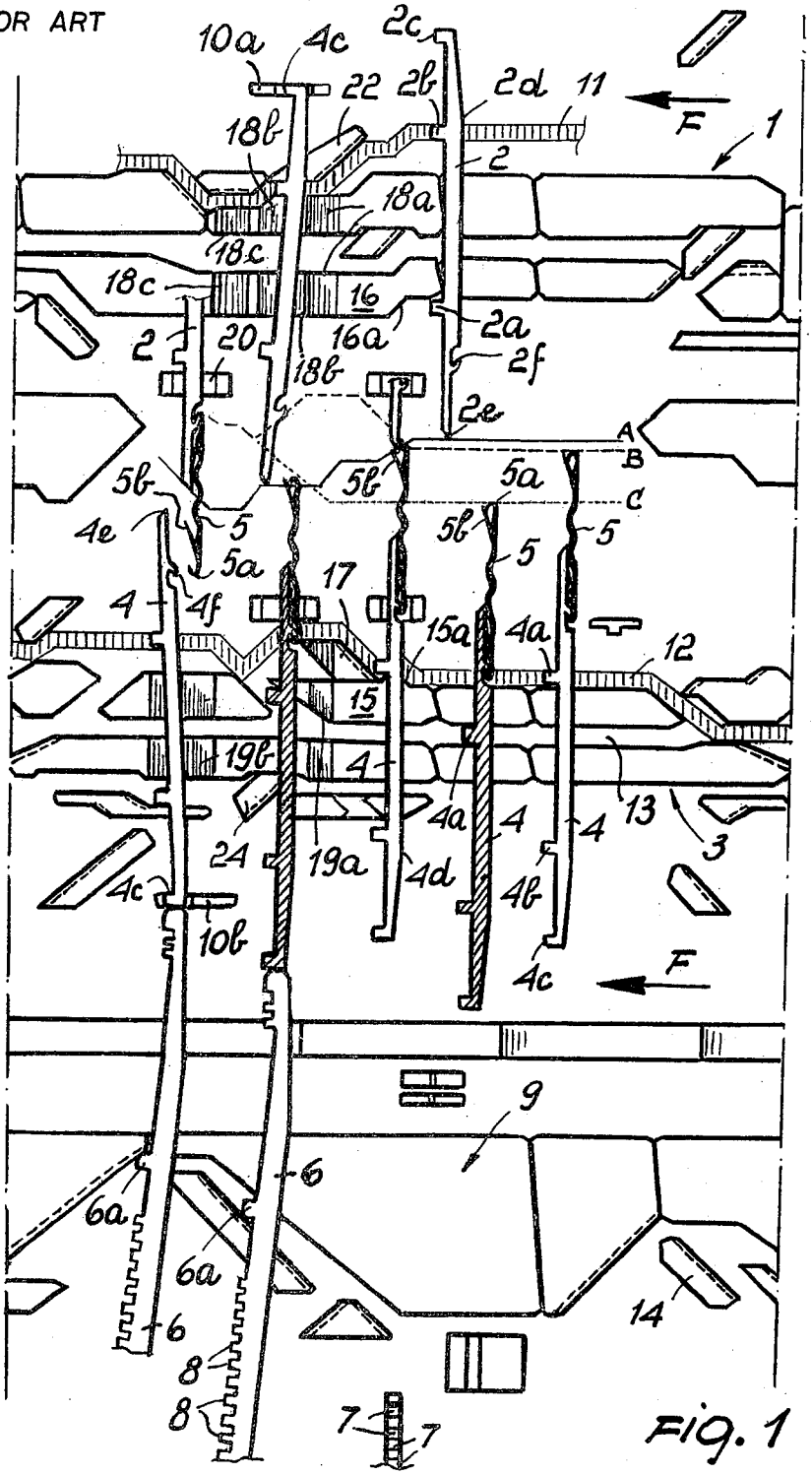
FIG. 1 shows the cams of a prior art double-cylinder circular knitting machine not equipped with the inventive device. The figure also shows some needle transfer phases from the lower needle cylinder to the upper one, the sliders and needles involved in such a transfer being depicted, for a clearer view, in a plane tilted by 90° to the acutal one. The sliders shown in dotted lines indicate instead sliders which have been erroneously guided into the "floating" track.

Making reference first to FIG. 1, a prior art double-cylinder circular knitting machine is considered which includes a cam ring 1 for driving or actuating the sliders 2 in the upper needle cylinder and a cam ring 3 for the driving of the sliders 4 in the lower needle cylinder. The numeral 5 denotes the double-hook needles, which are assumed for transfer from the lower needle cylinder to the upper one. The needles have at each ends a hook 5a and latch 5b. The numeral 6 denotes the selecting jacks for the lifting of the sliders 4 to the transfer position, the jacks being controlled in a known manner by the selecting levers 7 acting upon the patterning butts 8 of the selecting jacks. The selecting jacks arranged to bring the sliders 4 to the transfer position follow with their butts 6a a track defined by the cams of the lower cam ring 9.

The sliders 2 and 4 are each provided, in a known manner, with control butts 2a, 2b, 2c and 4a, 4b, 4c, respectively. Furthermore, the sliders are allowed to perform an oscillatory movement with fulcrum at 2d, respectively 4d, under the action of special cams 10a and 10b, as described hereinafter, which through the butt 2c, respectively 4c, push the slider end portion toward the bottom of their respective groove in the needle cylinder, thus causing the tip portion 2e, respectively 4e, to project outwards, in the proximity whereof the hook 2f, respectively 4f, is located for hooking up the needle 5.

The tracks followed by the facing sliders 2 and 4, specifically by the butts 2b and 4a thereof, prior to the transfer of a needle and during such a transfer, are denoted respectively with the numerals 11 and 12. The track 13 of FIG. 1 represents instead the "floating" track, also termed above as the second track. The arrowheads F indicate the movement of the sliders and needles with respect to the cam rings. The full line A depicts the path followed by the ends 2e of the sliders 2, the dashed line B shows the path of the hooks 5a of the needles to be transferred, and the dotted line C indicates the level of the hooks 5a of the needles in the "floating" position.

The instance is now considered of a slider 4 correctly driven to effect the transfer, in a known manner, of a needle 5 from the lower needle cylinder to the upper needle cylinder. The slider 4 is first driven, by means of a special selecting jack (not shown), which acts on the cam 14, to engage the track 12 with its butt 4a. The control of the selecting jack is effected by a special selecting lever, not shown, actuated by a pattern drum provided with so-called safety teeth or pins. The needle 5 is with its upper hook at the level B, slightly lower than the level A of the overlying tip of the slider 2, which follows the track 11 with its butt 2b (see the rightmost slider and needle in FIG. 1). As the slider 4 reaches with its butt 4a the raising portion 15a of the cam 15, the slider 2 reaches with its butt 2a the descending portion 16a of the cam 16 and initiates the mutual approaching of the slider 2 and needle 5, which brings the tip 2e of the slider 2 to insertion between the latch 5b and hook 5a of the needle 5. The progressive descent of the slider 2, controlled by the portion 16a, and the progressive raise of the slider 4, controlled through the butt 4a engaging with the raising cam 17, determine a gradual opening of the latch 5b under the action of the tip 2e. Thus, the needle is fully opened and allowed to go over to the transfer.

Subsequently, the slider 2 comes down with its butt 2b along the cam 22, and on meeting with its hook 2f the needle hook 5a, tilts automatically into the recess 18a, thereafter it hooks up the needle owing to the tilting movement into the recess 18a, but immediately afterwards meets with its butt 2c the cam 10a which urges it to tilt into the recess 18b, thus releasing the needle which in the meantime begins to come down dragged by the slider 4, which descends along the cam 24 with its butt 4b.

Thereafter, the slider 4 which carries the needle involved in the transfer and purl stitching, meets its respective selecting jack 6, which, in its raising movement, urges it to push the needle 5 toward the slider 2 and to automatically tilt into the recess 18c.

At the end of said recess 18c, the slider 2 swings back, hooks up the needle and drags it along following the raising portion of the track 11, while the slider 4 concurrently releases the needle 5 and tilts into the recess 19b, urged to do so by the cam 10b engaging its butt 4c.

Since the latch 5b of the needle 5 upper hook has been previously opened, as described above, no breakage failure occurs either in the needle 5 or slider 2 at the instant of the swinging back thereof into the respective groove.

By contrast, in the prior art machine, when the slider 4, owing to a wrong arrangement of the pins on the specially provided pattern drum, fails to be lifted to the track 12, it stays with its butt 4*a* in the "floating" track 13. Such is the case with the slider 4 shown in dotted outline on the right of FIG. 1. This will stay with its butt 4*a* in the track 13 until it is lifted by its respective selecting jack 6 (slider 4, in dotted lines on the left), which selecting jack is not affected by the setting error on the preceding pattern drum. The raised slider 4 lifts its respective needle 5 to a position whereat the facing slider 2 in the upper needle cylinder is tilted outwardly by the cam 10*a*. If the latch 5*b*, as is often the case, is not in the opened state, the needle 5 and slider 2 break when the latter swings back and is pressed to the bottom of its groove by the cam 20.

To overcome this drawback, it is contemplated by the invention to provide an auxiliary cam 21 slightly upstream of the transfer area (FIG. 2), the cam being so configurated as to bring the needles associated with the sliders 4, which are guided with their butts 4*a* in the "floating" track 13, to a height level of contact with the tips 2*e* of the respective sliders 2 in the other needle cylinder, such as to effect the opening of the closed latches 5*b*. More specifically, the position of the auxiliary cam 21 and the height thereof are such as to bring the butt 4*a* out of the track 13 and the corresponding needle 5 to a level higher than the height reached by the tip 2*e* of the slider 2 after the latter has been lowered by engagement of the cam 22 with the butt 2*b*, thereby a relative movement is implemented of the tip 2*e* and needle effective to produce a progressive opening of the latch. This is best shown in FIG. 3. It should be noted here that during the first two phases shown, a relative linear motion occurs for a certain length of the needle and slider, which causes the tip 2*e* to progressively open the latch 5*b*, while later on, as the outward tilt of the slider begins, the latch is further opened to approximately a horizontal position of the same, owing to the tip 2*e* engaging with the end portion of the latch.

At this stage, even if the latch fails to open fully, e.g. does not drop under its own weight, but stays in the position reached, no failure can occur, since as the slider swings back the tip 2*e* follows again the same path which it followed when swinging out, thereby it cannot hit the latch. Consequently, it is no longer necessary to calculate the height of the cam 21 such as to open the latch to a nearly horizontal position, a narrower opening being quite adequate. At the end of the swinging out and back steps, the slider and needle start again to move linearly toward each other, such that the latch is fully opened and the hooking up is performed as usual, as shown for the sliders 2 and 4 on the extreme left of FIG. 2.

By providing the auxiliary cam 21, not only the needles and sliders are effectively protected against breakage but it also becomes possible to transfer those needles the sliders whereof have erroneously been started along the "floating" track 13.

The sliders 4 which, on the contrary, have been correctly directed to this track 13, since uninvolved in knitting at the feed immediately following the transfer area, are also subjected to the action of the cam 21, wherefor they advantageously bring their respective needles to the latch opening position, to be then lowered once again by the successive cam 23 to the level of the "floating" track 13, without ever going to a transfer proper since no selecting jack 6 is provided for them in the raise phase along the cams 9 track.

Figure 2:
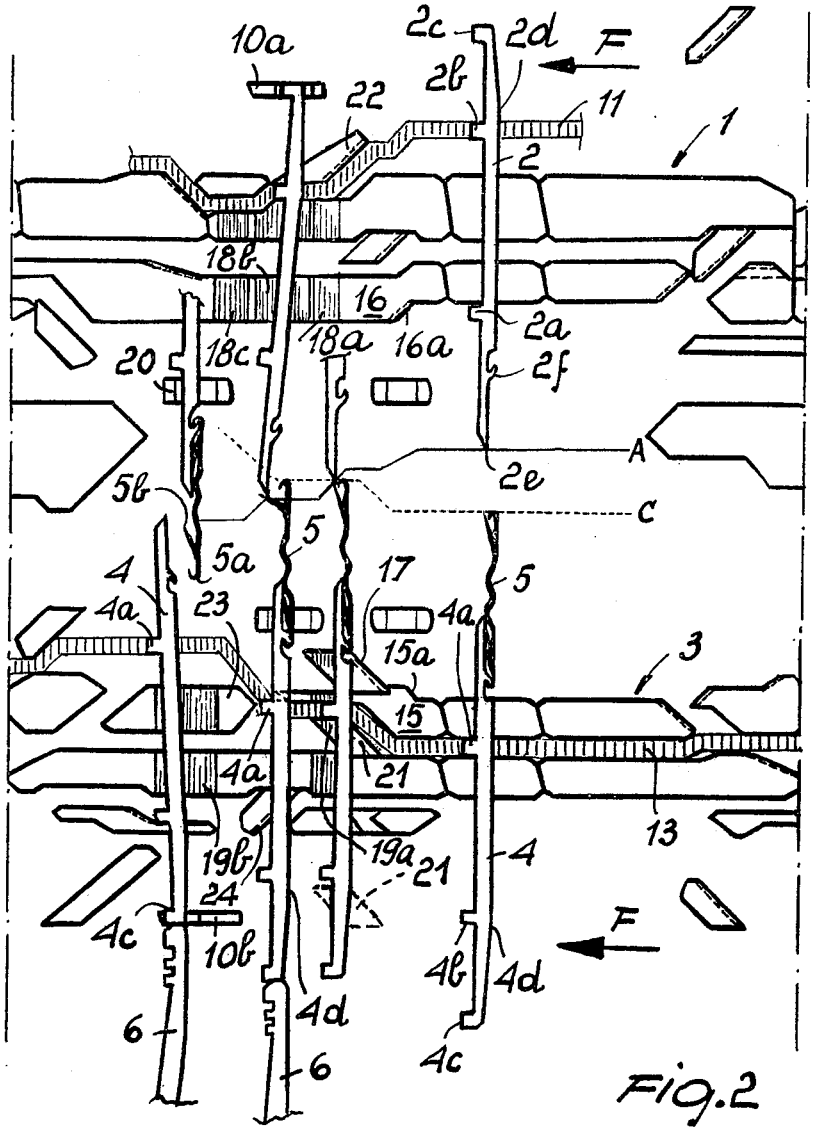
FIG. 2 shows the cams of a machine according to the invention, and how the opening of the latch and transfer of a needle associated with a slider engaged on the "floating" track are carried out, the needle and slider being represented as tilted by 90°.
Figure 3:
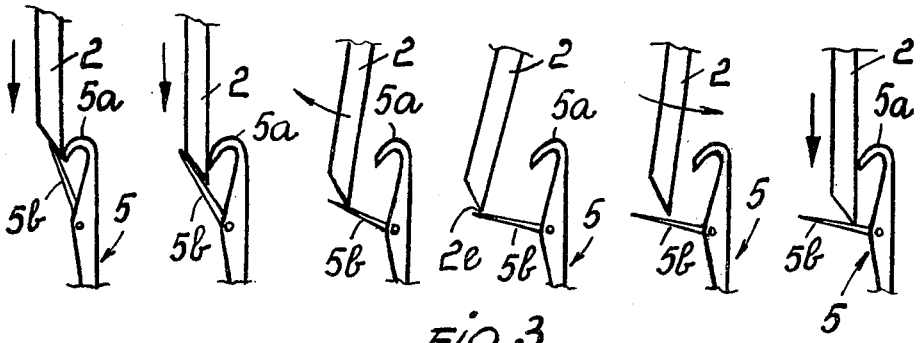
FIG. 3 shows, to an enlarged scale, some phases relating to the opening of the latch prior to the hooking up of the needle by the overlying slider in a machine according to this invention.

The auxiliary cam 21 may be either radially movable or stationary, and may be arranged at the level of the track 13, as shown in full lines in FIG. 2, or alternatively at a different height, as shown in dotted lines, whereat it acts on the butt 4*b* of the slider 4 to cause the latter to complete the same movement as described above.

The invention, as described hereinabove, also reduces the pattern drum preparation time, as it is no longer required that the safety pins be set on these drums. The resulting advantage, in relation to the elimination of possible errors as well, is evident.

Obviously, the invention may find application also on different machines from the one considered, for example on machines set to execute the knitting known as "links-floating", by floating the needles in the lower needle cylinder on the first feed when the pattern drum is on the lower needle cylinder. This same inventive concept may also be applied to the transfer of needles from the upper needle cylinder to the lower one, that is for passing from purl stitching to plain stitching. Furthermore, such a concept is applicable to large diameter double-cylinder circular knitting machines as well, and with suitable adaptations, also to flat bed knitting machines with two needle beds, in other words to any machine with double-hook needles.

I claim:

1. A double-cylinder circular knitting machine having latch needles and a safety device for the opening of the needle latches, comprising needles to be transferred from one of the two needle cylinders to the other thereof and needles not to be transferred, a transfer area, transfer members facing each other within the two needle cylinders and having control butts, each of said needles engaging a corresponding one of said transfer members, and control cams for said butts of said transfer members defining at least a first track for the butts of the transfer members associated with said needles to be transferred and at least a second track for the butts of the transfer members associated with said needles not to be transferred, and further comprising an auxiliary cam located upstream of said transfer area and configurated to bring the butts of the transfer members of one of said needle cylinders which are guided in said second track out of said second track and the corresponding needles to a height level of contact with the respective facing transfer members of the other of said needle cylinders, thereby providing a gradual opening of the needle latches by said facing transfer members, and a subsequent cam configurated to bring the butts of the transfer members associated with said needles not to be transferred back to said second track.

2. A machine according to claim 1, characterized in that said auxiliary cam is arranged radially movable with respect to said needle cylinders.

3. A machine according to claim 1, characterized in that said auxiliary cam is located at the level of said second track to interact with the butts of the transfer members in engagement with said second track.

* * * * *